US011661748B2

(12) United States Patent
Ben Saad et al.

(10) Patent No.: US 11,661,748 B2
(45) Date of Patent: May 30, 2023

(54) METHOD FOR PRODUCING A FACING

(71) Applicant: SAINT-GOBAIN ISOVER, Courbevoie (FR)

(72) Inventors: Manel Ben Saad, La Garenne Colombes (FR); Patrice Freslon, Marmande (FR); Jérôme Goudard, Gentilly (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 0 days.

(21) Appl. No.: 17/253,513

(22) PCT Filed: Jun. 19, 2019

(86) PCT No.: PCT/FR2019/051494
§ 371 (c)(1),
(2) Date: Dec. 17, 2020

(87) PCT Pub. No.: WO2019/243737
PCT Pub. Date: Dec. 26, 2019

(65) Prior Publication Data

US 2021/0262240 A1 Aug. 26, 2021

(30) Foreign Application Priority Data

Jun. 19, 2018 (FR) ..... 1855395

(51) Int. Cl.
*E04F 13/08* (2006.01)
*E04B 1/41* (2006.01)
*E04B 2/72* (2006.01)

(52) U.S. Cl.
CPC ..... *E04F 13/0841* (2013.01); *E04B 1/40* (2013.01); *E04B 2/723* (2013.01)

(58) Field of Classification Search
CPC ..... E04F 13/0841; E04B 1/40; E04B 2/723; E04B 2002/728
See application file for complete search history.

(56) References Cited

U.S. PATENT DOCUMENTS 994,768 A * 6/1911 McAuliffe ..... E04B 2/723 52/285.3
2,218,273 A 10/1940 Wilhoyte
(Continued)

FOREIGN PATENT DOCUMENTS

EP 2 754 770 A1 7/2014
FR 2 110 097 A5 5/1972
(Continued)

OTHER PUBLICATIONS

International Search Report as issued in International Patent Application No. PCT/FR2019/051494, dated Nov. 21, 2019.

*Primary Examiner* — Patrick J Maestri
(74) *Attorney, Agent, or Firm* — Pillsbury Winthrop Shaw Pittman LLP

(57) ABSTRACT

A method for producing a facing includes at least one first panel and one second panel that are each delimited by a front face and a rear face connected by a lateral edge, the method including a) a first panel is fitted, b) a first part of a connector is fastened to the first panel such that a second part of the connector projects beyond said first panel, c) a second panel is fitted next to the first panel and fastened to the second part of the connector.

16 Claims, 7 Drawing Sheets

(56) References Cited

U.S. PATENT DOCUMENTS

| | | | | | |
|---|---|---|---|---|---|
| 2,379,179 | A | | 6/1945 | Petersen | |
| 4,782,642 | A | * | 11/1988 | Conville | E04G 23/0203 52/489.1 |
| 5,152,117 | A | * | 10/1992 | Wynar | E04B 2/7457 52/712 |
| 2007/0245679 | A1 | * | 10/2007 | Conville | E04B 9/30 52/712 |

FOREIGN PATENT DOCUMENTS

| | | | |
|---|---|---|---|
| KR | 10-2002-0028103 | A | 4/2002 |
| WO | WO 2009/127031 | A1 | 10/2009 |
| WO | WO 2014/185854 | A1 | 11/2014 |

* cited by examiner

Fig.9
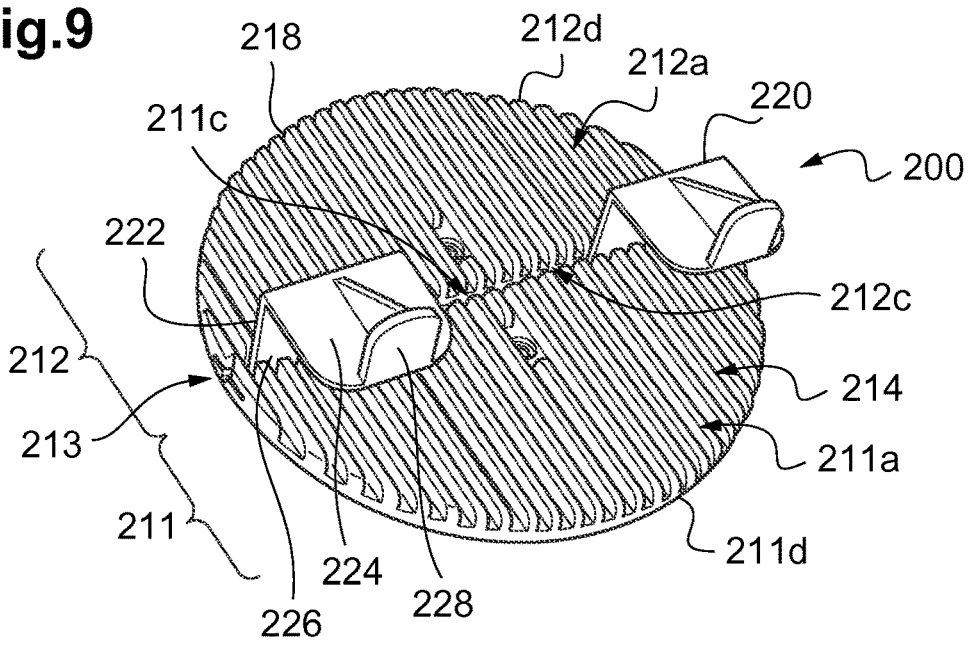
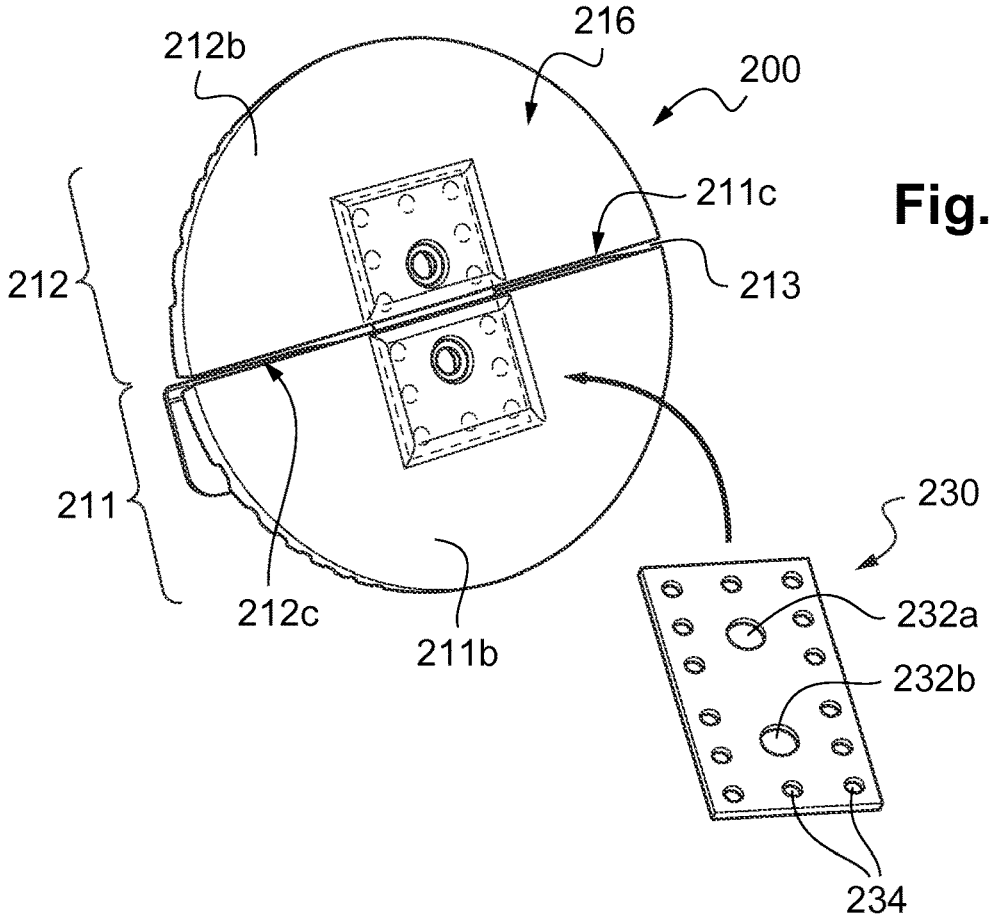
Fig.10

METHOD FOR PRODUCING A FACING

CROSS-REFERENCE TO RELATED APPLICATIONS

This application is the U.S. National Stage of PCT/FR2019/051494, filed Jun. 19, 2019, which in turn claims priority to French patent application number 1855395 filed Jun. 19, 2018. The content of these applications are incorporated herein by reference in their entireties.

TECHNICAL FIELD

The present description relates to a method for producing a facing, in particular a facing of a room partition or of a lining partition of a structure such as a wall, a partition, a ceiling, a rake.

BACKGROUND OF THE INVENTION

As is well known, a room partition is generally formed of two facings fastened on either side of a framework comprising a plurality of metal members, generally equidistant, disposed vertically between and nested in two horizontal members, also referred to as top rail and bottom rail, fastened to the ceiling and to the floor, respectively.

A lining partition is made up for example of a facing, attached to a framework comprising a plurality of bracing devices fastened to the structure to be lined and metal members of the type described above, which are fastened to these bracing devices and nested in two horizontal members fastened to the ceiling and to the floor, respectively.

In the case of a room partition and of a lining partition of the abovementioned type, each facing is formed by a juxtaposition of panels having a width corresponding to a multiple of the distance between two adjacent vertical metal members. The lateral edges of a panel are thus in continuous contact, over their entire height, with a vertical metal member, ensuring the planarity of the facing at the junction between panels.

In order to make it easier to fit partitions and reduce the associated costs, the applicant is currently developing a new type of framework, which makes it possible to produce room partitions and lining partitions that do not have vertical metal members or, at the very least, does not require any screwing of panels in such vertical members. This new type of framework employs a plurality of point support elements, disposed at a distance from the top and bottom rails, for example half-way up, configured such that the panels can be fastened directly thereto without interposition of metal members. With such a system, the lateral edges of the facing panels are supported only at points, in zones known as support zones, by point support elements. Between two support zones, the edges of the panels are free. There is then a risk of two adjacent panels not being at the same level (meaning that their front faces are not locally coplanar), impairing the esthetic finish of the facing. Moreover, the facing, which is not very rigid, can be deformed between two support zones, when a force is applied orthogonally to the panel, for example by a person pressing on the partition.

OBJECT AND SUMMARY OF THE INVENTION

One of the objectives of the present invention is to remedy the abovementioned drawbacks of the prior art.

This objective is achieved by a method for producing a facing, in particular a facing of a room partition or of a lining partition, said facing comprising at least one first panel and one second panel that are each delimited by a front face and a rear face connected by a lateral edge, the method comprising at least the following steps:

a) a first panel is fitted, b) a first part of a connector is fastened to the first panel such that a second part of the connector projects beyond said first panel, c) a second panel is fitted next to the first panel and fastened to the second part of the connector.

The method according to the invention makes it possible to locally connect two adjacent panels that are not supported by a metal member. It is particularly suitable for the production of a facing in front of a framework comprising individual point support elements instead of vertical metal members, in line with the junctions between panels (it should be noted that a vertical member is understood here to be a member orthogonal to the horizontal direction, which may optionally be inclined).

The method according to the invention ensures better rigidity and durability of the facing and avoids level unevenness at the junction between panels, which make the finish unattractive and sometimes impossible.

A panel may be for example a plasterboard sheet, which is or is not provided with a decorative coating, is in one piece or has a sandwich structure or a laminated structure made of several sheets bonded together.

A panel may also be a sheet of cement board, of timber, of wood composite (agglomerate, OSB). It may also be made from a plastics material or a metal material, or from any other suitable material.

The material of which it is made (plaster, plastic, etc.) may optionally be reinforced with fibers (mineral fibers, cellulosic fibers, etc.).

In one example, the first panel is fastened to a framework before the connector is fitted.

The framework may for example comprise:

at least one point support element provided, at a first end, with an overall planar surface for the direct support of a panel and, at a second end, with means for fastening it to an adjacent structure, for example an opposite facing or a structure to be lined (it should be noted that "direct support" means direct support or support via a thin layer of glue or a thin adhesive element), and/or top and bottom horizontal members that are fastened to the ceiling and to the floor, respectively. These may be for example C profiles, also known as rails, or simple angle bars.

It will be understood that, in contrast to such a framework, the connector is intended to be connected only to the panels that it links, and to no other structural element, in particular the structure to be lined (in the case of a lining partition), the adjacent facing (in the case of a room partition, the floor, the ceiling etc.). The connector is therefore normally fastened only to the first and second panels.

In one example, in step b), the connector is fastened to the first panel such that the rear face of the latter is placed against the first part of the connector.

In one example, the first part of the connector comprises a main face and at least one lug comprising a wedging wing extending from said main face, and during step b), the main face of the first part is fitted on the rear face of the first panel and the wedging wing is wedged against the edge of the first panel.

In the present application, the main face is understood to be the face of an element intended to be oriented toward the room to be delimited by the facing, after it has been mounted.

In one exemplary embodiment, the first part is provided with clamping means designed to cooperate with the edge of the first panel.

For example, the lug also comprises a projection extending from the wedging wing and forming a receiving part with the main face of the first part and the wedging wing, and during step b), the receiving part is engaged over the edge of the first panel.

The connector is thus mounted on the first panel, either by force if the lug is rigid and the width of the receiving part is equal to or slightly less than the width of the panel, or by elastic deformation of the lug, the U-shaped receiving part forming a clip that clamps the panel.

In one example, the lug is cut or broken at the end of step b) or c). This prevents it from impeding the production of the joint between panels, or from remaining visible after jointing. Generally, the connector is preferably not visible following the production of the facing, meaning that it is not visible from the room that the facing delimits.

In some cases, the facing is not linear. The first panel and the second panel then form a salient or reentrant angle. In this case, the connector is folded before it is fastened to the first panel, by an angle corresponding to the desired angle between the first panel and the second panel.

In one example, in step c), the second panel is fitted next to the first panel such that its rear face is placed against the second part of the connector.

The connector can for example be fastened to the first and/or the second panel by screwing. In one variant or in addition, it can be fastened to the first and/or the second panel by adhesive bonding, in particular by means of a glue or an adhesive element of the film or tape type, or by a combination of screwing and adhesive bonding. In another variant, the first part and/or the second part of the connector can be fastened to the first and/or to the second panel only by clamping (of the edge of the panel in a receiving part in particular).

The invention also relates to a connector for implementing the method as defined above, comprising a first part for fastening it to the first panel and a second part for fastening it to the second panel.

In one example, at least one of the first and the second part of the connector, preferably the first and the second part of the connector, comprises an overall planar main face. The connector preferably comprises an overall planar main face.

In one example, the connector is such that the ratio between the largest transverse dimension and the smallest transverse dimension of the or each main face is at most 3, in particular at most 2. The connector can then be fastened quickly and easily to the first panel after the latter has been fitted and the second panel can be fastened quickly and easily to the connector, while preventing the deformation of the facing.

In one example, the or each main face is textured. A "textured face" means that the face in question has a relief, made up of a succession of peaks and troughs. This relief may be periodic or random. The texturing of the surface may also have a plurality of different reliefs that are distributed regularly or randomly. By way of example, the contact face may be provided with concentric and/or honeycomb ribs and/or grooves.

In one example, the first part has at least one lug provided with a wedging wing extending from its main face, orthogonally to said main face.

In one example, the lug also comprises a projection extending from the wedging wing and forming a receiving part with the main face of the first part and the wedging wing.

Advantageously, the lug is designed to be entirely or partially removable. In order to make it easier to take hold of the lug in order to remove it, the projection may bear gripping means such as a gripping tab.

In one example, the connector comprises, extending perpendicularly to the face on the opposite side from the main face of the connector, gripping means in order to make it easier to take hold of the connector while it is being fitted and fastened to the first panel.

In one particular exemplary embodiment, the connector comprises means for pivoting the first and the second parts with respect to one another. To this end, the first part and the second part can be connected for example by at least one metal core, the metal core forming a foldable intermediate part between the first and the second part.

Finally, the invention relates to a kit comprising at least one connector as defined above and at least one point support element provided, at a first end, with an overall planar surface for the direct support of a panel and, at a second end, with means for fastening it to an adjacent structure, for example an opposite facing or a structure to be lined.

A number of exemplary embodiments are described in the present description. However, unless specified to the contrary, the features described in relation to any one exemplary embodiment can be applied to another exemplary embodiment.

BRIEF DESCRIPTION OF THE DRAWINGS

The invention will be understood better and the advantages thereof will become clearer on reading the following detailed description of a number of exemplary embodiments depicted by way of nonlimiting examples. The description refers to the appended drawings, in which:

FIGS. 3, 4 and 8 are front views of the facing being produced, and FIGS. 5 to 7 are views on the section plane V in FIG. 4;

FIG. 9 illustrates a connector according to a second exemplary embodiment of the invention (front face);

FIG. 10 illustrates the rear face of the connector from FIG. 9, and shows, by dashed lines, the internal structure thereof;

DETAILED DESCRIPTION OF EXEMPLARY EMBODIMENTS

Figure 1:
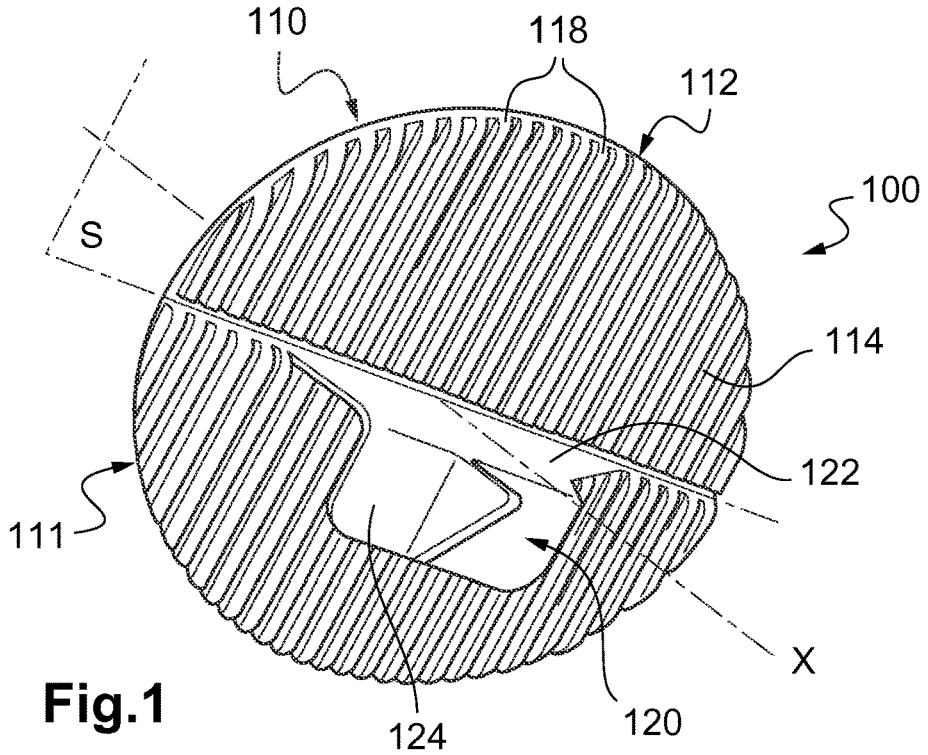
FIG. 1 illustrates a connector according to a first exemplary embodiment of the invention (front face)
Figure 8:
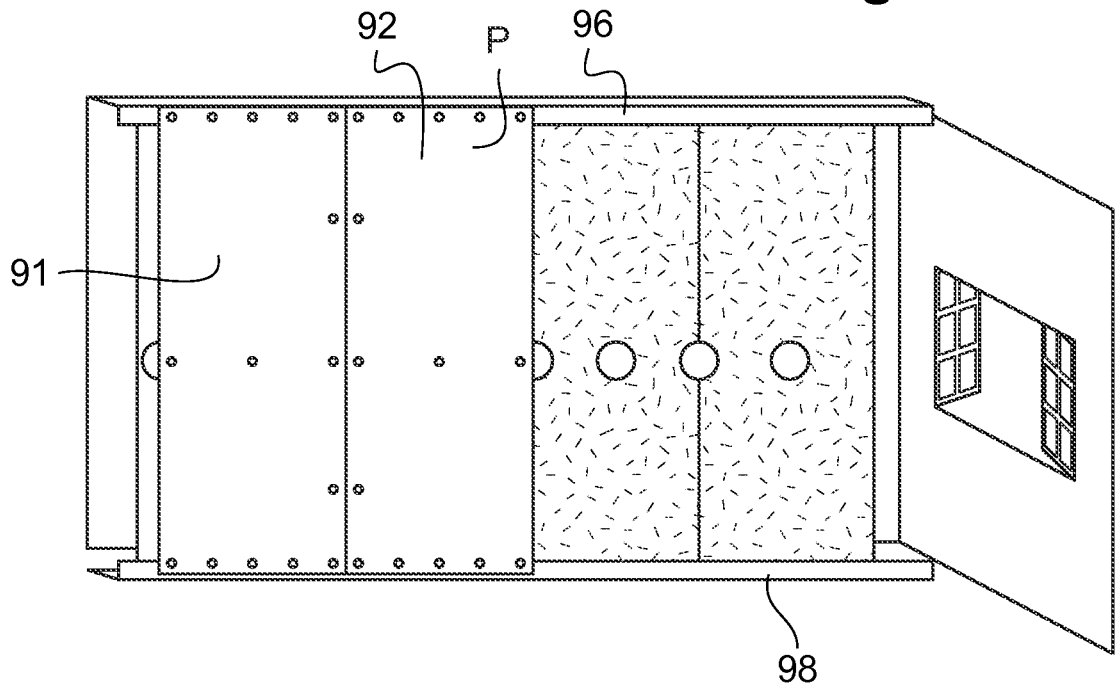

FIG. 1 illustrates a connector 100 according to a first exemplary embodiment of the present invention, which is intended to locally form the link between two panels 91, 92 of a facing P, as illustrated in FIG. 8.

Hereinbelow, the following are defined for each panel 91, 92:

a front face 91*a*, 92*a* oriented toward the interior of the room intended to be at least partially delimited by the facing P, a rear face 91*b*, 92*b* on the opposite side from the front face 91*a*, 92*a*, and an edge 91*c*, 92*c*.

More generally, the terms front and rear are used, throughout the description, with reference to the location of the components on the final facing, the front being oriented toward the interior of the room intended to be at least partially delimited by the facing P, the rear being oriented away from said room.

Figure 7:
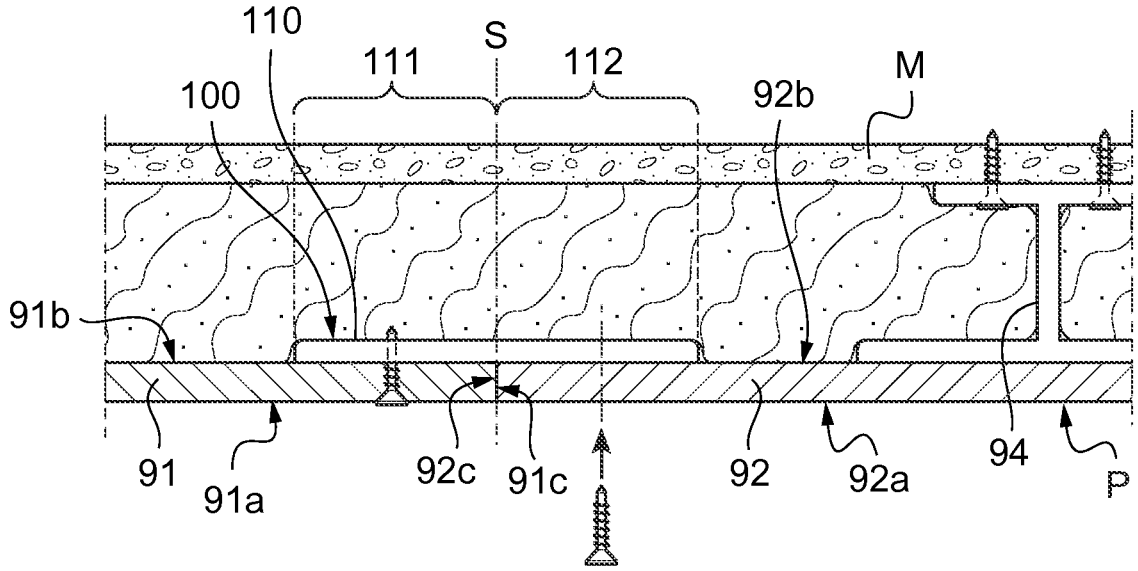

With reference to FIG. 7, the general principle of the method according to the invention is as follows:

the connector 100 is fastened by a first part (referenced 111 below) to a first panel 91 such that a second part of the connector (referenced 112 below) projects beyond said first panel 91, a second panel 92 is fitted next to the first panel 91 and fastened to the second part 112 of the connector 100, and so on for the following panels.

In this first exemplary embodiment, the connector 100 is a one-piece element made of a thermoplastic material such as a polyamide filled or not filled with glass fibers, polypropylene, or the like.

Figure 14:
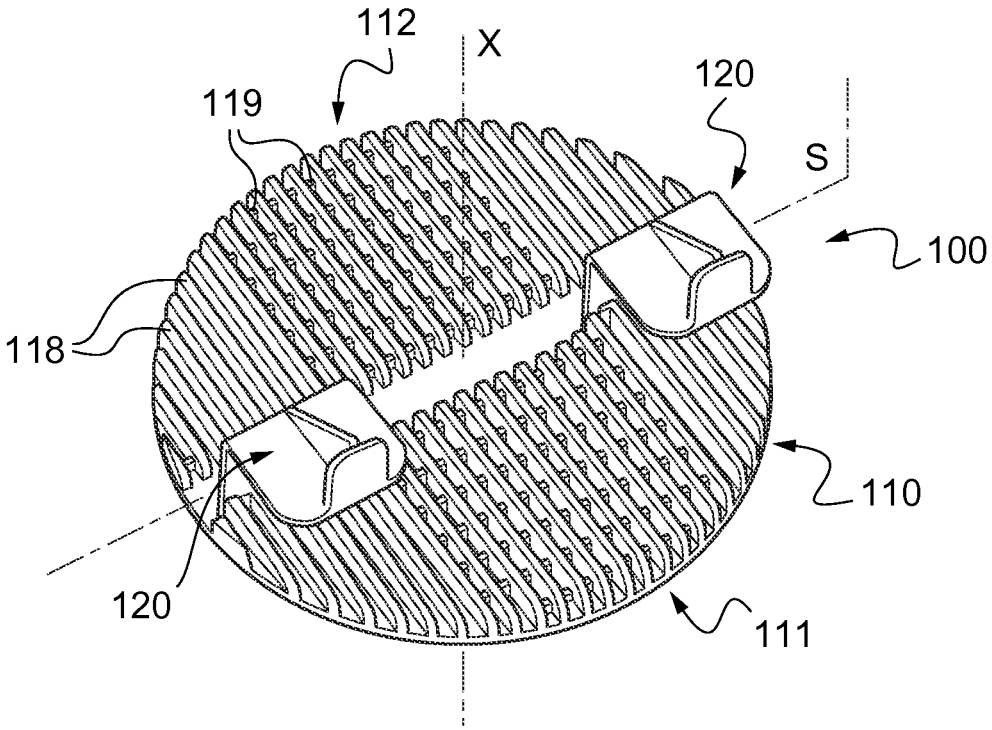

As illustrated in FIG. 1 and FIG. 14, the connector 100 comprises a main part 110 exhibiting the overall form of a mounting plate, in this case generally circular of central axis X. In a variant, the connector 100 may, however, exhibit any other suitable section, for example square, rectangular, hexagonal, octagonal, etc.

In the example, and as will become apparent from the rest of the description, the limit between the first part 111 of the connector, which is intended to be fastened to the first panel 91, and the second part 112 of the connector, which is intended to be fastened to the second panel 92, corresponds to a transverse plane of the main part 110, in this case its plane of symmetry S.

Figure 2:
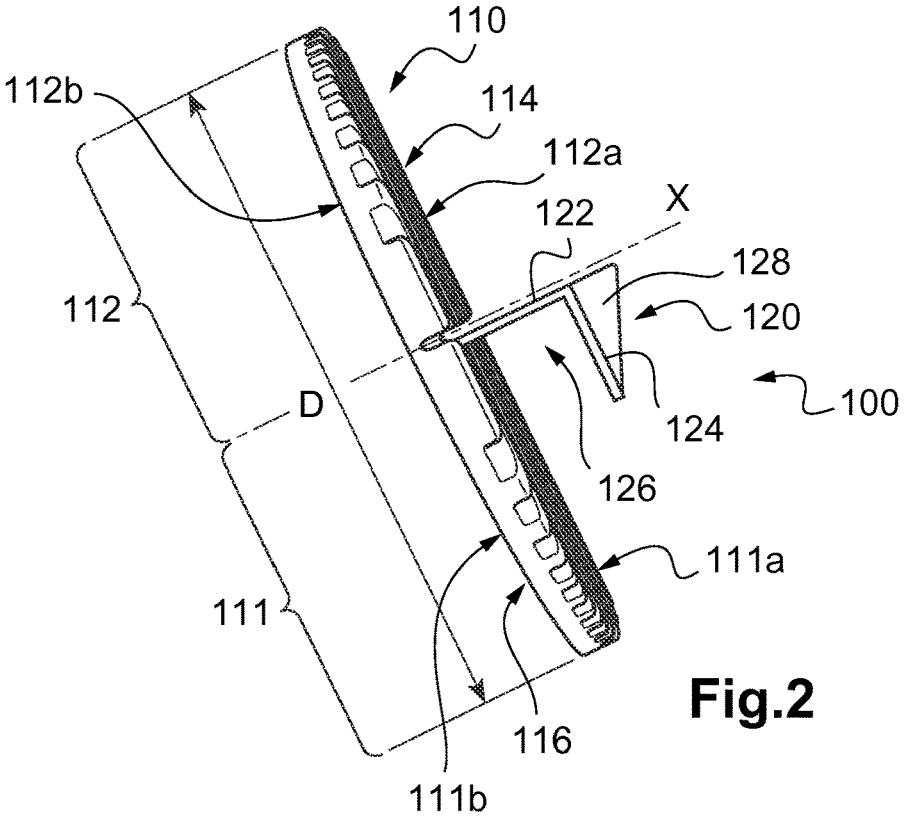
FIG. 2 illustrates the connector from FIG. 1 in side view.

As illustrated in more detail in FIG. 2, the main part 110 is in this case delimited, in the direction X, by two faces: a front face 114, known as the main face of the connector, formed by main faces 111*a*, 112*a* of the first and second parts 111, 112, and a rear face 116 of the connector, formed by the rear faces 111*b*, 112*b* of the first and second parts 111, 112. In the example, the main faces 111*a*, 112*a* are coplanar, as are the rear faces 111*b*, 112*b*.

In the example, the main face 114 of the connector is entirely textured, meaning that it has a relief made up of a succession of peaks and troughs. This is a periodic relief, formed of a plurality of parallel ribs 118 with the same height and the same width. In the variant shown in FIG. 14, the relief also comprises, in the central part of the main face 114, a plurality of parallel ribs 119 that are arranged perpendicularly to the ribs 118 and have a smaller height than the latter. This configuration makes it possible, in the case of screwing the panels, to prevent the screw from turning the connector or from being inserted at an angle.

The texturing of the main face 114 allows improved coupling of the fastening screws or, in the case of fastening by means of a glue, increases the contact area of the glue with the mounting plate.

In the example, the main face 114 of the connector remains overall planar, however, in order to be able to be in stable contact with the rear faces 91*b*, 92*b* of the first and the second panel 91, 92, as described in more detail below. Overall planar means that the top points of this face are situated substantially in a single plane, or more generally that its envelope surface is substantially planar.

The minimum transverse dimension of the main face 114, denoted D here, is greater than or equal to 30 mm, preferably greater than or equal to 45 mm. The minimum transverse dimension means the smallest dimension of the connector measured in a plane orthogonal to the axial direction X. The maximum transverse dimension of the main face 114 is preferably less than or equal to 600 mm, in particular less than or equal to 400 mm, and even less than or equal to 200 mm.

In addition, the total surface area of the main face 114 of the connector is preferably greater than at least 900 $mm^2$, preferably greater than 2025 $mm^2$. The total surface area of the main face 114 of the connector is preferably less than 3000 $cm^2$, in particular less than 1000 $cm^2$, and even less than 300 $cm^2$. The total surface area means here the surface area of the envelope surface of the contact face 114.

In the example illustrated, it has an axial section with a diameter D equal to 8 cm.

As illustrated in FIG. 2, the rear face 116 of the connector 100 may also be planar or more or less planar.

Figure 13:
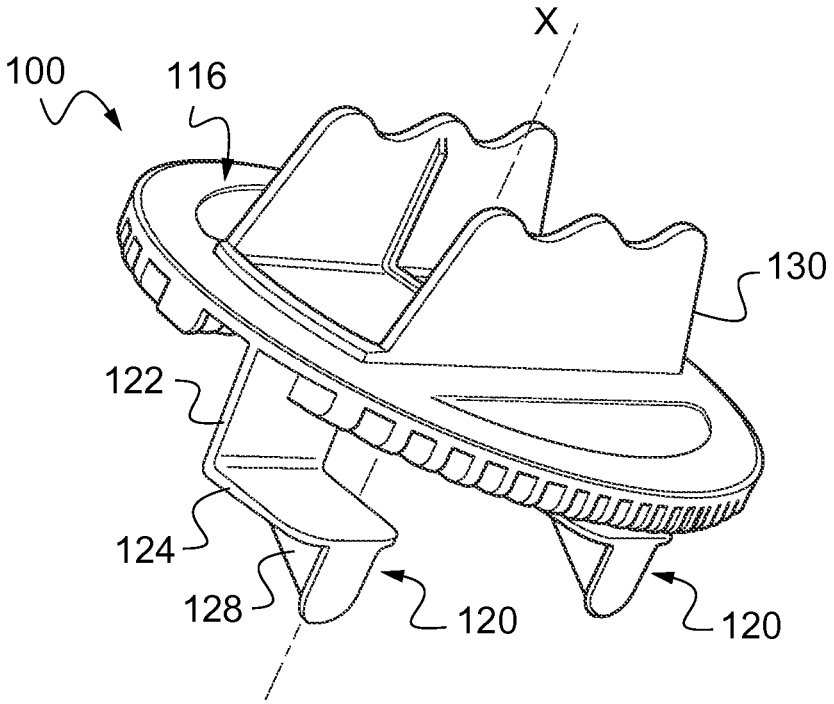

In a variant illustrated in FIG. 13, the rear face 116 is also provided with gripping means 130 that make it easier to position and fasten the connector, in particular by allowing it to be taken hold of at the time it is fitted on the first panel and while it is being screwed thereto. These gripping means are in this case in the form of two mutually parallel wings that extend toward the rear in the axial direction X.

In the example in FIGS. 1 and 2, the first part 111 of the connector 100 is provided with a lug 120 extending toward the front from its main face 111*a*. In the example in FIGS. 13 and 14, the first part 111 is provided with two lugs 120.

The or each lug 120 comprises a wedging wing 122 extending from the main face 111*a* and orthogonal to this main face 111*a*. It extends at the periphery of the main part 111, along the transverse plane S of the main part 110.

The or each lug 120 also comprises a projection 124 that defines, with the wing 122 and the main face 111*a*, a U-shaped receiving part 126, the receiving part 126 being open next to the main part 111 of the connector.

Finally, the or each lug comprises gripping means 128, on the projection 124, in this case in the form of a tab protruding toward the front.

In a variant, the or each lug 120 could also have only the wedging wing 122, or only the wedging wing 122 and the projection 124, without gripping means 128.

Advantageously, the or each lug 120 is designed to be able to be removed after the connector 100 has been fastened to the first panel 91 and before or after it has been fastened to the second panel. For example, the wedging wing 122 may be sufficiently thin to be able to be detached under the effect of a sufficient pulling force, the application of which can be made easier by the gripping means. In a variant, precut lines can also be made at the base of the wedging wing 122 or of the projection 124.

FIGS. 3 to 8 illustrate the production of the facing of a lining partition attached to the front of an existing wall M, according to one implementation example of the present invention using the connector from FIGS. 1 and 2.

As is well known, the facing P is formed by the juxtaposition of a plurality of panels 91, 92, etc.

In the example, the facing P is attached to a framework comprising a plurality of bracing devices 94 fastened to the wall to be lined, and two horizontal metal members 96, 98 fastened to the ceiling and to the floor, respectively.

The bracing devices 94 are in this case point support elements provided, at a first end (front), with an overall planar surface 94*a* for the direct support of a panel and, at a second end 94*b*, with means for fastening it to the wall to be lined M, for example a mounting plate for screwing or means for clip-fastening to a metal member.

Figure 3:
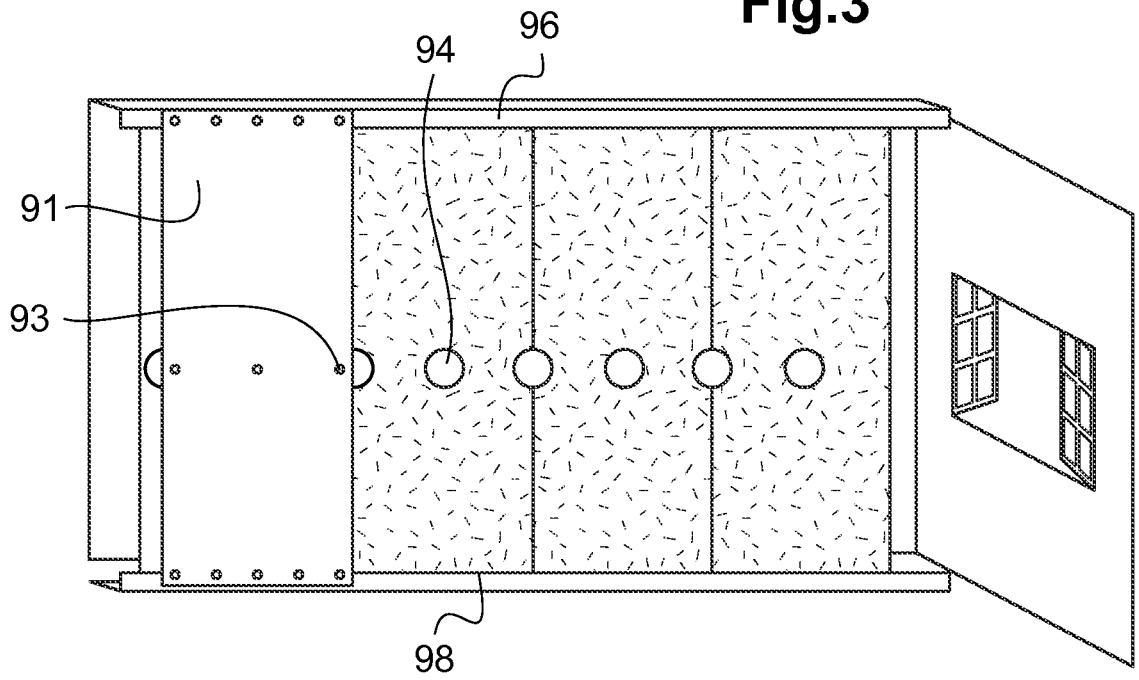
FIGS. 3 to 8 illustrate, step by step, the production of a facing according to a first implementation example of the method of the invention, with the aid of connectors according to FIGS. 1 and 2.

In a first step, illustrated in FIG. 3, the first panel 91 is fitted in its final position and then fastened, generally by screws 93, to the horizontal metal members 96, 98 and to the point support elements 94. At the end of this first step, the lateral edges of the panel 91 are not supported in the intermediate zones between the metal members 96, 98 and the bracing devices 94.

Figure 4:
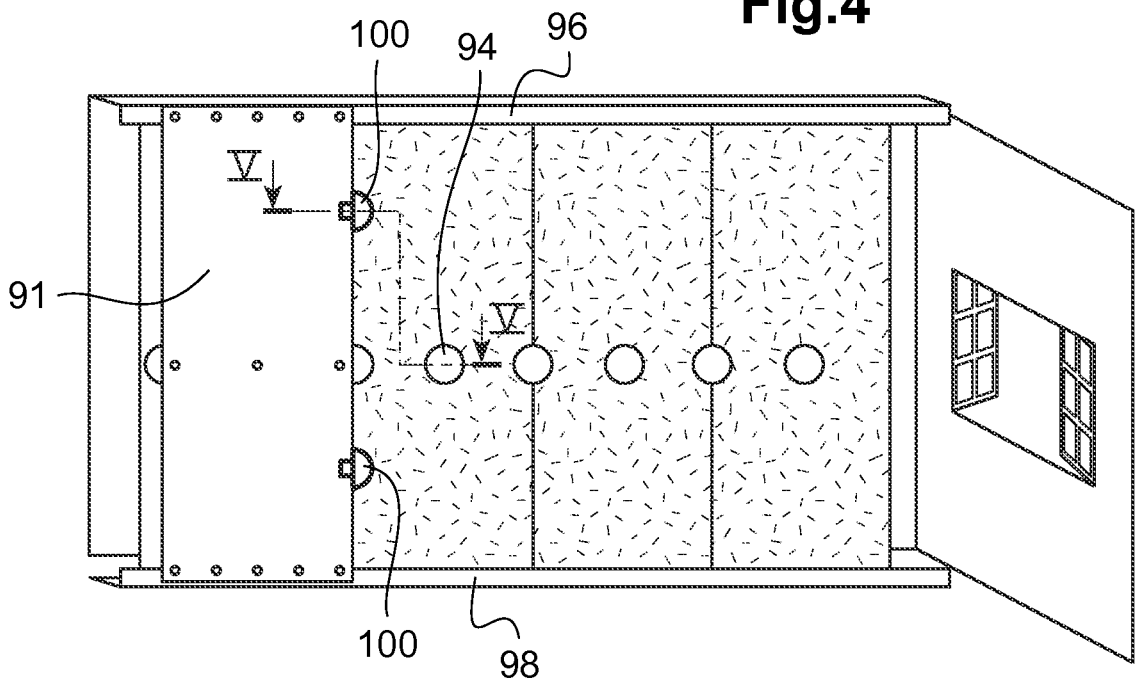

In a second step, illustrated in FIG. 4, connectors 100 are fitted on the panel 91, preferably at the center of each intermediate zone, by engaging their receiving part 126 over the edge of the panel 91. Each connector 100 is in this case mounted on the edge of the panel 91, either by force if the lug 120 is rigid and the width of the receiving part 126 is equal to or slightly less than the thickness of the panel 91, or by deformation of the lug. In the latter case, with the lug being returned elastically into its initial position, the U-shaped receiving part forms a clip that clamps the panel.

Each connector 100 is thus positioned such that the main face 111*a* of its first part is in contact with the rear face 91*b* of the first panel 91, that a first face of the wedging wing 122 is in contact with the edge 91*c* of the first panel 91, and that the second part 112 of the connector projects laterally beyond the first panel 91, thus remaining free, in the continuation of the first panel.

Figure 5:
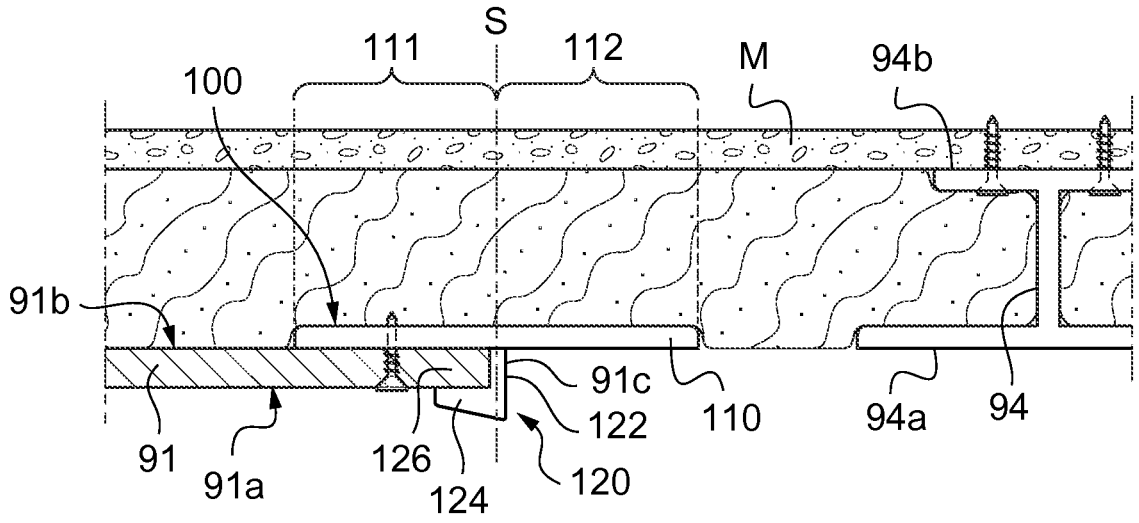

In a third step illustrated in FIG. 5, the connector 100 is fastened to the first panel 91, for example by screwing through the first panel 91 and the first part 111.

Figure 6:
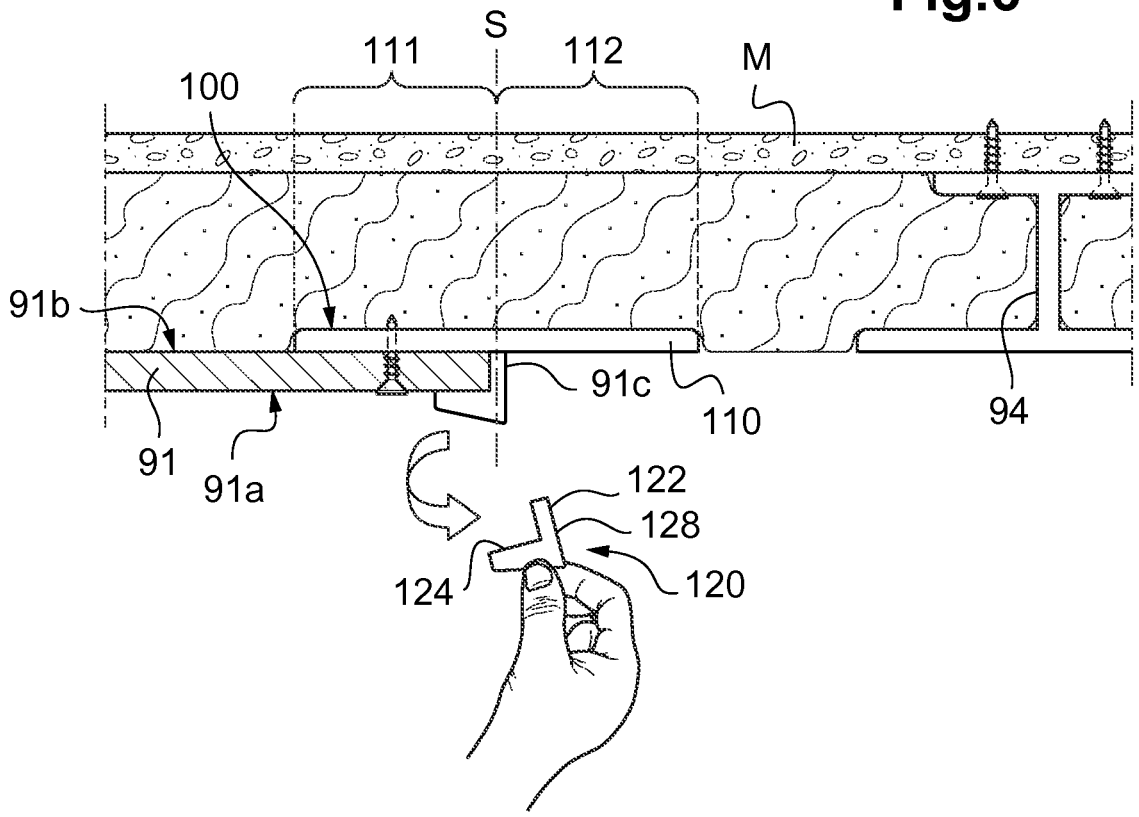

Following this third step, as illustrated in FIG. 6, the lug 120 is optionally cut or broken, preferably at its base or optionally at the junction between the wing 122 and the projection 124. This then prevents it from impeding the production of the joint between panels, or from remaining visible after jointing. In a variant, if, however, the projection 124 is sufficiently thin and has a substantially planar front surface, the lug can also remain in place and be covered by the jointing product.

In a fifth step, illustrated in FIG. 7, the second panel 92 is fitted next to the first panel 91, with its edge 92*c* in contact with the edge 91*c* of the first panel 91 and with the right-hand face of the wedging wing 122 and with its rear face 92*b* in contact with the main face 112*a* of the second part 112 of the connector.

In a sixth step (FIG. 8), the second panel 92 is finally fastened to the second part 112 of the connector 100, for example by screwing through the second panel 92 and said second part 112.

At the same time, the second panel 92 is also fastened to the framework formed here by the horizontal members 96, 98 and the bracing devices 94.

According to one variant, the framework could for example be formed only of horizontal members 96, 98, or only of point support elements, or of a combination of horizontal members and/or point support elements with vertical members.

Furthermore, while FIGS. 3 to 8 illustrate the production of a facing attached to the front of an existing wall M, the method according to the invention can be implemented in the same way to produce any facing comprising at least two panels, in particular a facing for lining a ceiling, a rake, or for producing a room partition.

FIGS. 9 and 10 illustrate a connector 200 according to a second exemplary embodiment of the invention.

The connector 200 differs from the one in the first embodiment in that it comprises a first part 211 (intended to be fastened to the first panel 91) and a second part 212 (intended to be fastened to the second panel 92) that are movable with respect to one another about an intermediate part forming a hinge 213.

Figure 11:
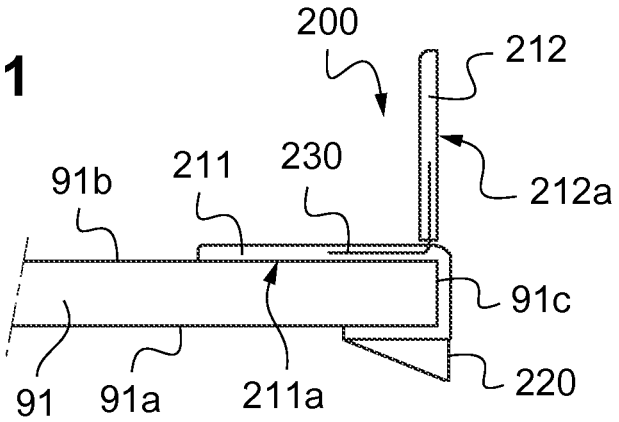
FIGS. 11 and 12 illustrate the production of a facing according to a second implementation example of the method of the invention, with the aid of a connector according to FIGS. 9 and 10, FIGS. 13 and 14 illustrate a variant of the connector according to the first exemplary embodiment, showing the rear face and the front face, respectively, of the connector.
Figure 12:
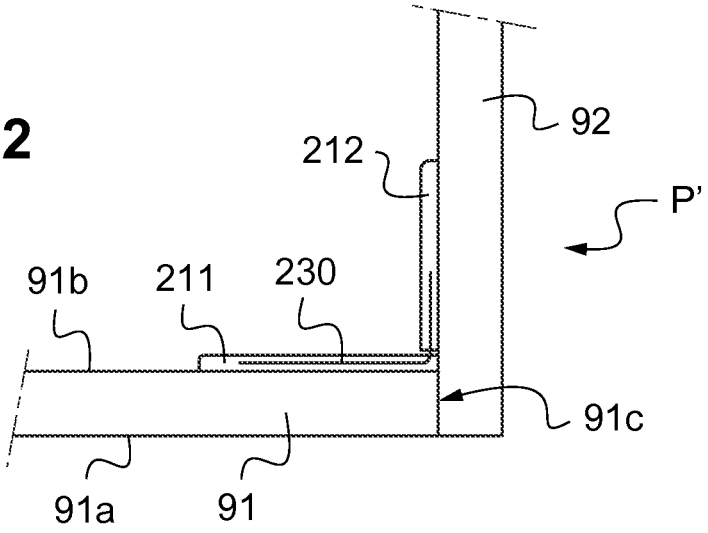

The connector 200 is thus designed to pass from a non-folded state, as illustrated in FIGS. 9 and 10, to a folded state, illustrated in FIGS. 11 and 12. It can therefore be used to locally link two panels 91, 92 that form a salient or reentrant angle with one another.

In the example, each part 211, 212 form a substantially semicircular mounting half-plate delimited by a front face (known as the main face) 211*a*, 212*a*, respectively, and a rear face 211*b*, 212*b*, respectively. The main faces 211*a*, 212*a* of the two mounting half-plates jointly form the main face 214 of the connector 200, and their rear faces 211*b*, 212*b* form the rear face 216 of the connector 216.

Furthermore, an inner edge 211*c*, 212*c*, respectively, and an outer edge 211*d*, 212*d*, respectively, are defined for each mounting half-plate 211, 212, with the inner edges oriented toward the intermediate part 213.

In the non-folded state illustrated in FIGS. 9 and 10:

the main faces 211*a*, 212*a*, respectively, of the two parts 211, 212 are situated in one and the same plane.

The inner edges 211*c*, 212*c* face one another and are spaced apart by a preferably small distance of between 0.5 and 3 mm.

In the example, the first and second parts 211, 212 are connected by a metal core in the form of a plate 230, which is preferably made of galvanized steel and has typically a thickness of between 0.3 mm and 0.6 mm.

As illustrated in more detail in FIG. 10, the plate 230 is secured in part to the first part 211 and in part to the second part 212, a thin strip of plate 230, free between the first and second parts 211, 212, forming the intermediate part 213. This part, which is deformable, forms a hinge for folding the connector 200.

The connector 200 is manufactured for example by overmolding the metal plate 230. To this end, said plate 230 has, in the example, two holes 232*a*, 232*b* that are intended to cooperate with stems for keeping it in position inside the injection mold. These holes may optionally serve for the introduction of screws when the connector 200 is fastened to the panels 91, 92, but this implementation is not limiting.

In order to ensure that the plate 230 is anchored properly on the first and second parts 211, 212, it is advantageously provided with a plurality of further through-holes 234, into which the material forming said parts 211, 212 passes during the injection.

As in the first exemplary embodiment, the connector has the main faces 211*a*, 212*a* of its first and second parts textured by a plurality of parallel ribs 218. These main faces remain overall planar, however.

The first part 211 of the connector is also provided with two lugs 220, which are each similar to the one 120 described in connection with the first exemplary embodiment and each have:

a wing 222 extending from the edge 211*c* of the first part 211 that is adjacent to the second part 212 and orthogonally to the front face 211*a* of said first part 211, a projection 224 that defines a U-shaped receiving part 226 with the wing 222 and the face 211*a*, gripping means 228, on the projection 224, in this case in the form of a tab protruding toward the front.

According to a variant of this second embodiment that is not shown, the intermediate part forming a hinge is positioned perpendicularly to the intermediate part 213 shown in FIGS. 9 and 10. The intermediate part is therefore situated between the wings 222, along the axis of symmetry of the connector. Such a configuration makes it possible to manage the (reentrant or salient) angles and to produce window sills.

FIGS. 11 and 12 illustrate the use of a connector 200 according to FIGS. 9 and 10 for producing a facing P' having at least two joined panels 91, 92 forming a right angle.

FIG. 11 illustrates the connector 200 fastened to the first panel 91. Before being fitted, the connector 200 was folded such that the main face 211*a* of the first part 211 and the main face 212*a* of the second part 212 form an angle of 90° between one another.

Once the lug 220 has been removed, the second panel 92 is fitted against the edge 91*c* of the first panel 91 and the main face 212*a* of the second part of the connector 200, and is then fastened to this second part 212, for example by screwing.

In the present case, in order to produce a facing with a salient angle, the first and second parts 211, 212 were folded toward the rear (so as to move their rear faces 211*b*, 212*b* toward one another). In order to produce a reentrant angle, the first and second parts 211, 212 should simply be folded forward (so as to move their main faces 211*a*, 212*a* toward one another).

The invention claimed is:

1. A method for producing a facing, said facing comprising at least one first panel and one second panel that are each delimited by a front face and a rear face connected by a lateral edge, the method comprising at least the following steps:

a) installing a first panel, b) fastening a first part of a connector to the first panel such that a second part of the connector projects beyond said first panel, c) installing a second panel next to the first panel and fastening the second panel to the second part of the connector, wherein the connector comprises means for pivoting the first and the second parts with respect to one another, and the connector is not visible following the production of the facing, wherein the first part of the connector comprises a main face and at least one lug comprising a wedging wing extending from said main face, and during step b), the main face of the first part of the connector is installed on the rear face of the first panel and the wedging wing is wedged against the edge of the first panel, and wherein the lug is cut or broken at the end of step b) or step c).

2. The method as claimed in claim 1, wherein, in step c), the second panel is positioned next to the first panel such that its rear face is placed against the second part of the connector.

3. The method as claimed in claim 1, wherein the lug also comprises a projection extending from the wedging wing and forming a receiving part with the main face of the first part and the wedging wing, and during step b), the receiving part is engaged over the edge of the first panel.

4. The method as claimed in claim 1, wherein the connector is folded before the connector is fastened to the first panel, by an angle corresponding to the desired angle between the first panel and the second panel.

5. The method as claimed in claim 1, wherein the connector is fastened to the first and/or to the second panel by screwing and/or adhesive bonding.

6. The method as claimed in claim 1, wherein the connector is fastened only to the first and second panels.

7. A connector for implementing a method for producing a facing, said facing comprising a first panel and a second panel that are each delimited by a front face and a rear face connected by a lateral edge, the connector comprising a first part for fastening it to the first panel and a second part for fastening it to the second panel, wherein at least one of the first and the second part comprises an overall planar main face, wherein the first part has at least one lug provided with a wedging wing extending from its main face, orthogonally to said main face, and the lug is designed to be entirely or partially removable, and wherein the connector comprises means for pivoting the first and the second parts with respect to one another and the connector is not visible following the production of the facing.

8. The connector as claimed in claim 7, wherein the main face is textured.

9. The connector as claimed in claim 7, wherein the lug also comprises a projection extending from the wedging wing and forming a receiving part with the main face of the first part and the wedging wing.

10. The connector as claimed in claim 9, wherein the projection bears gripping means.

11. The connector as claimed in claim 7, wherein the first part and the second part are connected by at least one metal core, the metal core forming a foldable intermediate part between the first and the second part.

12. A kit comprising at least one connector as claimed in claim 7 and at least one point support element provided, at a first end, with an overall planar surface for the direct support of a panel and, at a second end, with means for fastening it to an adjacent structure.

13. The connector as claimed in claim 8, wherein the main face is provided with concentric or honeycomb ribs or grooves.

14. The kit as claimed in claim 12, wherein the adjacent structure is an opposite facing or a structure to be lined.

15. The method as claimed in claim 1, wherein the first part has a first inner edge and the second part has a second inner edge, the first inner edge facing the second inner edge and being spaced apart from the second inner edge, the first and second parts being pivotable with respect to one another, via said means for pivoting, about an axis that extends along said first and second inner edges.

16. The method as claimed in claim 1, wherein the means for pivoting includes a foldable intermediate part that is connected to the first and second parts of the connector.

* * * * *